US008842856B2

(12) United States Patent
Akino

(10) Patent No.: US 8,842,856 B2
(45) Date of Patent: Sep. 23, 2014

(54) CONDENSER MICROPHONE

(71) Applicant: Hiroshi Akino, Machida (JP)

(72) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 0 days.

(21) Appl. No.: 13/764,150

(22) Filed: Feb. 11, 2013

(65) Prior Publication Data

US 2013/0230195 A1 Sep. 5, 2013

(30) Foreign Application Priority Data

Mar. 2, 2012 (JP) ..... 2012-046178

(51) Int. Cl.

| | |
|---|---|
| ***H04R 25/00*** | (2006.01) |
| ***H04R 1/20*** | (2006.01) |
| ***H04R 1/38*** | (2006.01) |
| *H04R 19/04* | (2006.01) |

(52) U.S. Cl.

CPC *H04R 1/20* (2013.01); *H04R 19/04* (2013.01); *H04R 1/38* (2013.01)

USPC ..... 381/160; 381/355; 381/369

(58) Field of Classification Search

CPC ..... H04R 1/08; H04R 1/083; H04R 1/20; H04R 1/342; H04R 1/38; H04R 1/222; H04R 19/04; H04R 1/406

USPC ..... 381/113, 160, 355, 356, 357, 358, 359, 381/360, 361, 362, 369, 170, 174, 177

See application file for complete search history.

(56) References Cited

U.S. PATENT DOCUMENTS

| | | | | |
|---|---|---|---|---|
| 2,848,561 | A * | 8/1958 | Gorike | 381/357 |
| 2006/0078148 | A1 * | 4/2006 | Akino | 381/369 |

FOREIGN PATENT DOCUMENTS

| | | | |
|---|---|---|---|
| JP | 2007-053522 | A | 3/2007 |

* cited by examiner

*Primary Examiner* — Huyen D Le

(74) *Attorney, Agent, or Firm* — Manabu Kanesaka

(57) ABSTRACT

A condenser microphone which prevents a directional axis from varying depending on a sound source frequency is provided. The condenser microphone includes a first reflector member 2 provided below the microphone unit 17 and covering an electronic circuit substrate 19 and a second reflector member 3 formed in the same shape as the first reflector member and provided above the microphone unit, the first reflector member and the second reflector member being disposed symmetrically with respect to the microphone unit.

6 Claims, 7 Drawing Sheets

CONDENSER MICROPHONE

BACKGROUND OF THE INVENTION

1. Field of the Invention

The present invention relates to a condenser microphone, and in particular to a side-entry condenser microphone which prevents a directional axis from varying depending on a sound source frequency.

2. Description of the Related Art

A side-entry condenser microphone generally used at a studio includes a head case portion 11, a body portion 12 for supporting the head case portion 11 and a connector portion 13 mounted on the lower end side of the body portion 12 as shown in FIGS. 3 and 4. It is to be noted that FIG. 3 is a front sectional view of a conventional side-entry condenser microphone 50 and FIG. 4 is a side sectional view thereof.

A substantially whole part of the head case portion 11 is covered by a metallic guard net 16 which is supported by a frame member 15 formed of a metallic material such as brass.

Further, a condenser microphone unit 17 is disposed in an internal space covered by the guard net 16. As shown in FIG. 3, within the head case portion 11, this microphone unit 17 is supported on both right and left sides by an up-down extending stay 18 and disposed so as to orient its sound collecting axis in a horizontal direction.

Further, the body portion 12 is formed into a cylindrical shape also using a metallic material such as brass, and a circuit board 19 supported by the stay 18 is disposed therein. This circuit board 19 is mounted with an electronic circuit such as an audio output circuit including an impedance converter and a polarization voltage generating circuit.

Still further, the connector portion 13 has such a structure that an output connector 21 is disposed in a cylindrical portion also formed of a metallic material such as brass. Usually, as the output connector 21, an output connector of three-pin type connected to a phantom power source via a balanced shield cable is used.

In such a side-entry condenser microphone 50, the microphone unit 17 and the circuit board 19, and the circuit board 19 and the output connector 21 are electrically connected to each other by respective wirings (not shown), and the head case portion 11 for accommodating them, the body portion 12, and the connector portion 13 are connected integrally with machine screws.

Such a side-entry condenser microphone structure is disclosed in Japanese Patent Application Laid-Open Publication No. 2007-053522 (Patent Document 1).

Incidentally, in the above-mentioned side-entry condenser microphone 50, a case member (hereinafter referred to as a reflector member 20) is provided so as to cover the circuit substrate 19 and minimize a space for accommodating the microphone unit 17 as illustrated in the drawings.

This reflector member 20 is preferably formed to have a circular dome shape (it may also have a cone shape) in order to prevent generation of irregularities in intensity of sound wave inputted at a predetermined frequency.

However, in the case where the reflector member 20 is provided, since it is close to the microphone unit 17, there is a problem in that a location of sound terminals provided at front and rear positions of the microphone unit 17 is moved to an opposite side of the reflector member 20 with respect to the sound collecting axis, i.e. moved in the upward direction, thereby causing a directional axis in a vertical plane to be shifted in the upward direction (see arrows in FIG. 4).

This problem can be observed in a polar pattern illustrated in FIG. 5 showing a directivity of a microphone measured by the present applicant by use of a side-entry condenser microphone having the structure illustrated in FIG. 3.

Further, since the reflector member 20 has a predetermined dimension, a shifting amount of the directional axis depends on the frequency. As shown in a graph of FIG. 6 (a directional frequency response of FIG. 5), the shifting amount becomes small at lower frequencies and large in higher frequencies.

That is, in the structure of the conventional side-entry condenser microphone as shown in FIGS. 3 and 4, there is a problem in that the directional axis varies depending on the sound source frequency.

SUMMARY OF THE INVENTION

The present invention has been made in view of the above-mentioned problem and an object of the invention is to provide a side-entry condenser microphone which prevents a directional axis from varying depending on a sound source frequency.

In order to solve the above problem, a condenser microphone in accordance with the present invention comprising: a microphone unit disposed in a head case so as to orient a sound collecting axis in a horizontal direction, the microphone unit being provided with sound terminals at front and rear positions thereof; a first reflector member provided below the above-mentioned microphone unit; and a second reflector member formed in the same shape as the above-mentioned first reflector member and provided above the above-mentioned microphone unit, the above-mentioned first reflector member and the above-mentioned second reflector member being disposed symmetrically with respect to the above-mentioned microphone unit.

Further, the condenser microphone in accordance with the present invention preferably comprises an electronic circuit substrate electrically connected to the above-mentioned microphone unit, the above-mentioned electronic circuit substrate being covered by the above-mentioned reflector member.

According to this structure, the sound terminals provided at front and rear positions of the microphone unit are not shifted in upward and downward directions, whereby the conventional problem that the directional axis varies depending on the sound source frequency can be solved.

It is to be noted that the first reflector member and the second reflector member are preferably formed to have a dome shape with its convex surface oriented toward the microphone unit side.

Alternatively, the first reflector member and the second reflector member may be formed to have a cone shape with its convex conical surface oriented toward the microphone unit side.

According to this structure, it is possible to prevent generation of irregularities in intensity of sound waves inputted at a predetermined frequency to the sound terminal provided at the front position of the microphone unit.

According to the present invention, it is possible to provide a side-entry condenser microphone which prevents the directional axis from varying depending on the sound source frequency.

DESCRIPTION OF THE PREFERRED EMBODIMENTS

Figure 1:
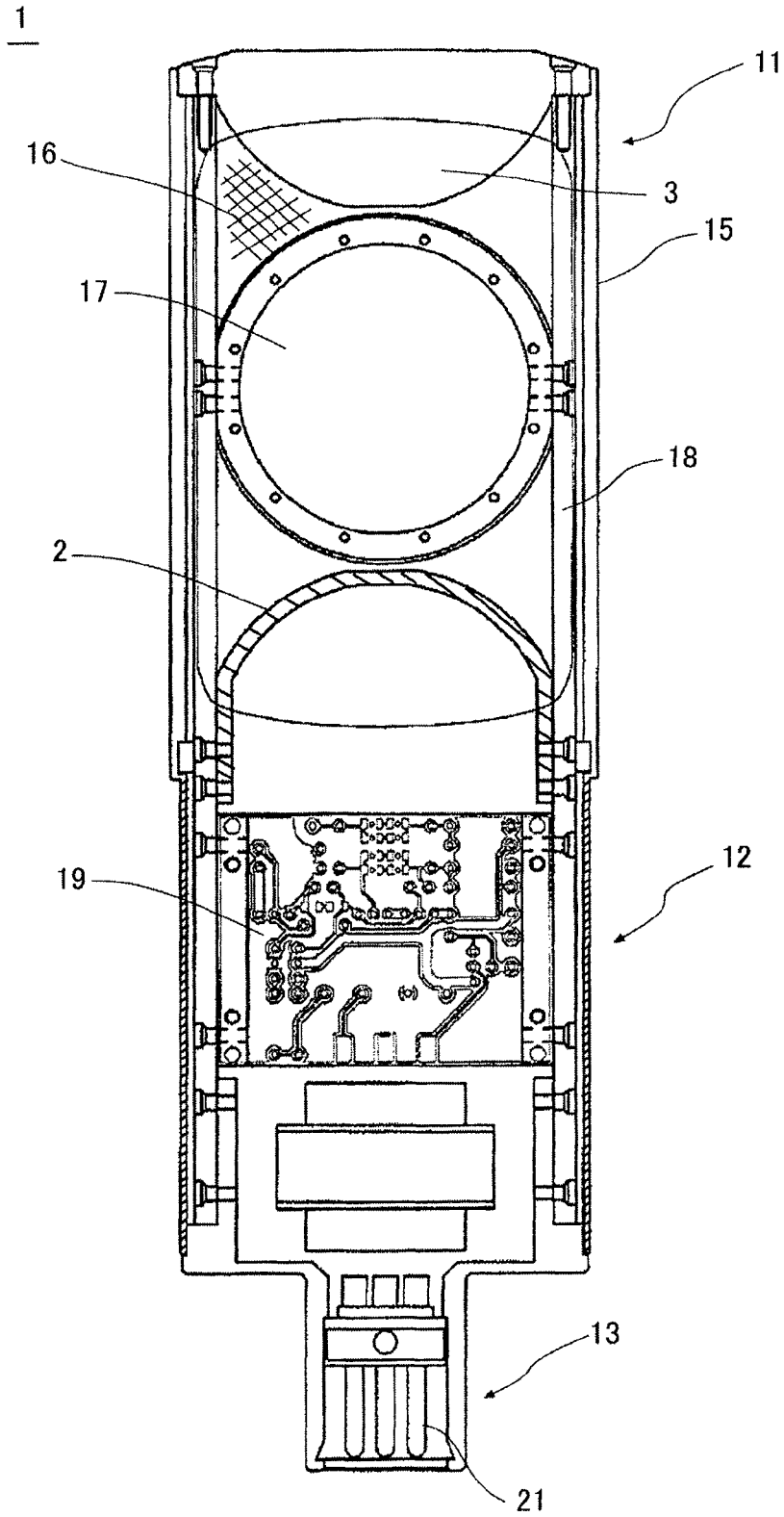
FIG. 1 is a front sectional view of a condenser microphone in accordance with the present invention.

Hereinafter, embodiments of the present invention will be described with reference to the accompanying drawings. FIG. 1 is a front sectional view of a condenser microphone in accordance with the present invention, FIG. 2 is a side sectional view thereof.

Figure 2:
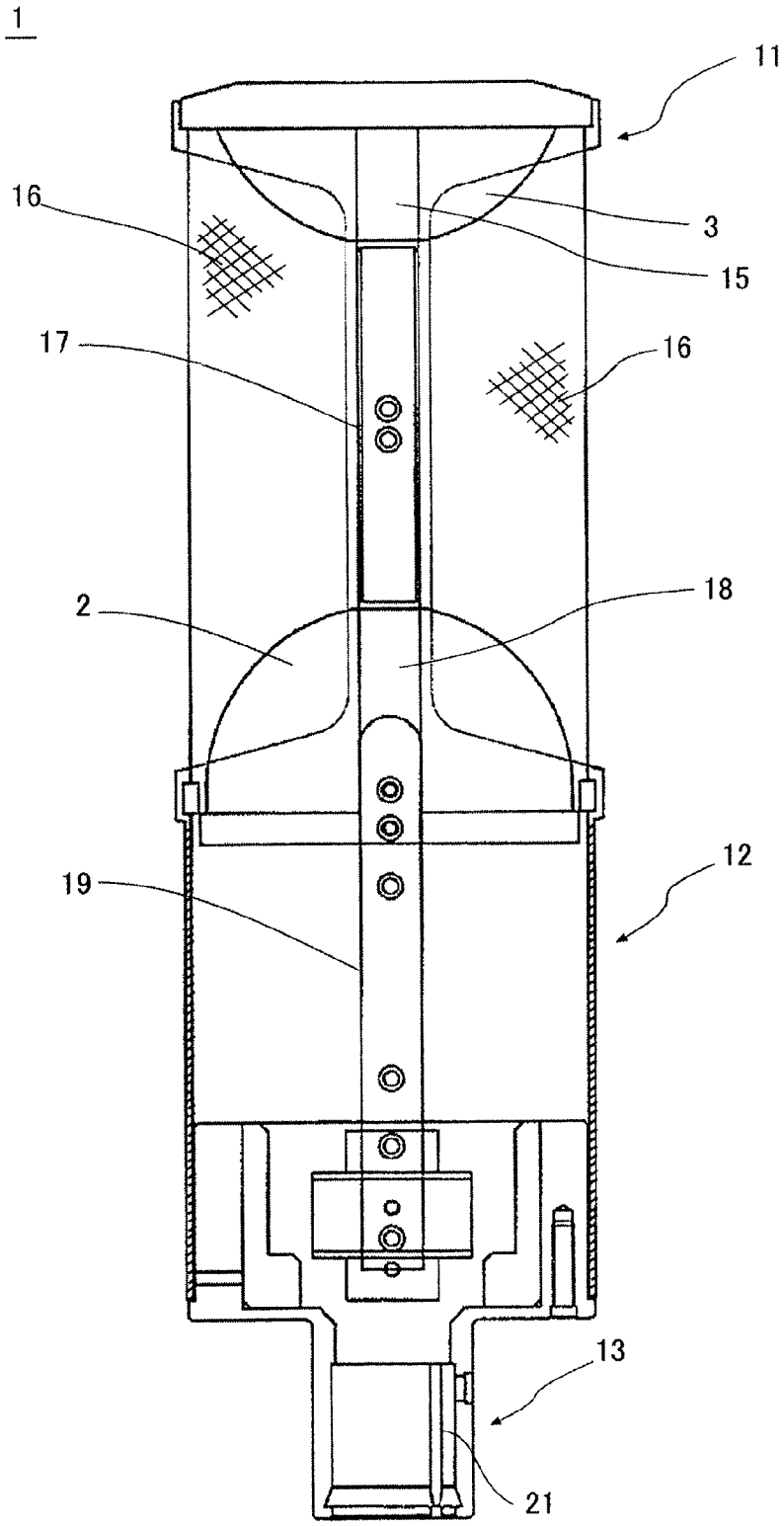
FIG. 2 is a side sectional view of the condenser microphone in accordance with the present invention.
Figure 3:
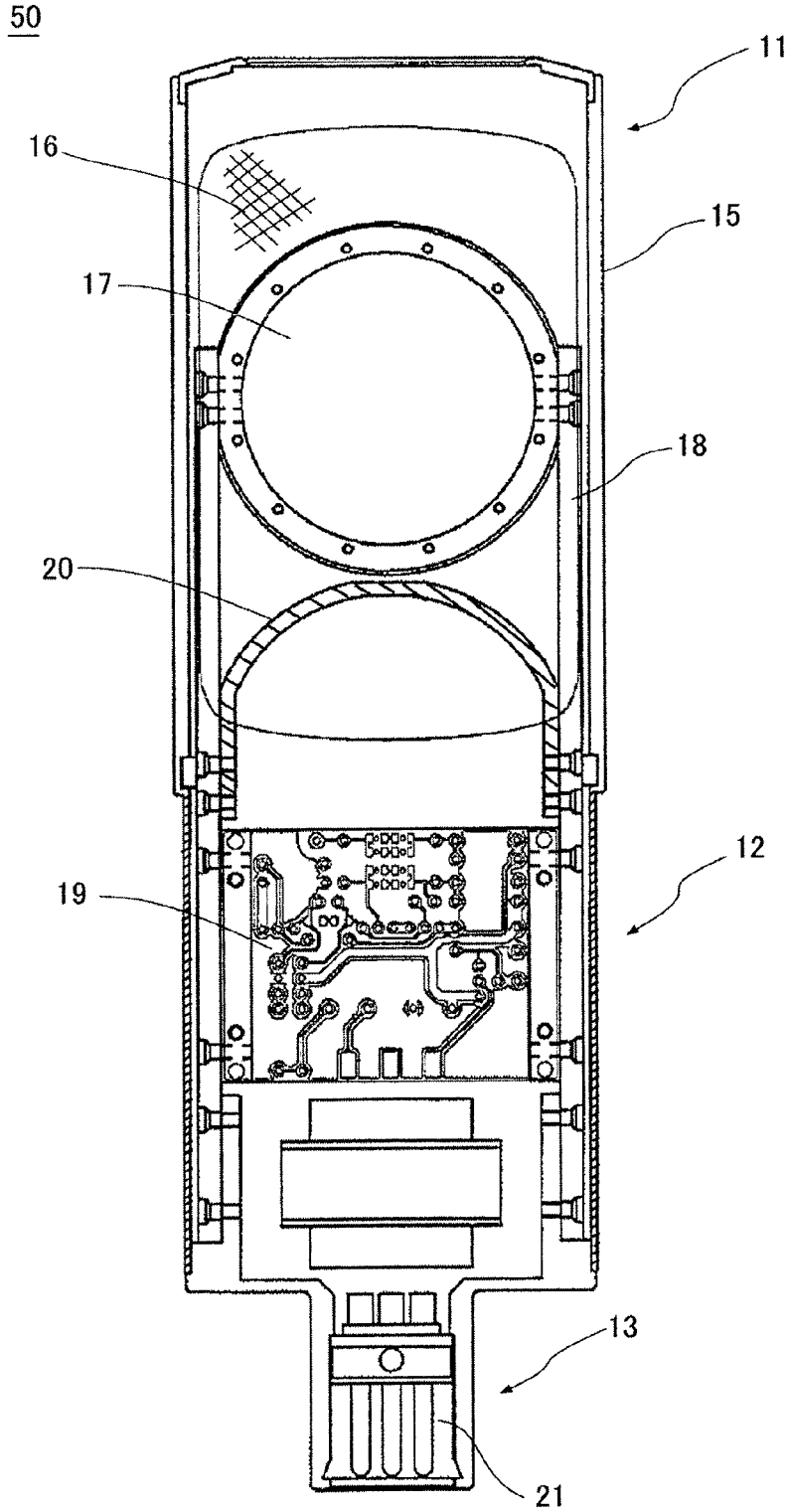
FIG.3 Prior Art
FIG. 3 is a front sectional view of a conventional condenser microphone.
Figure 4:
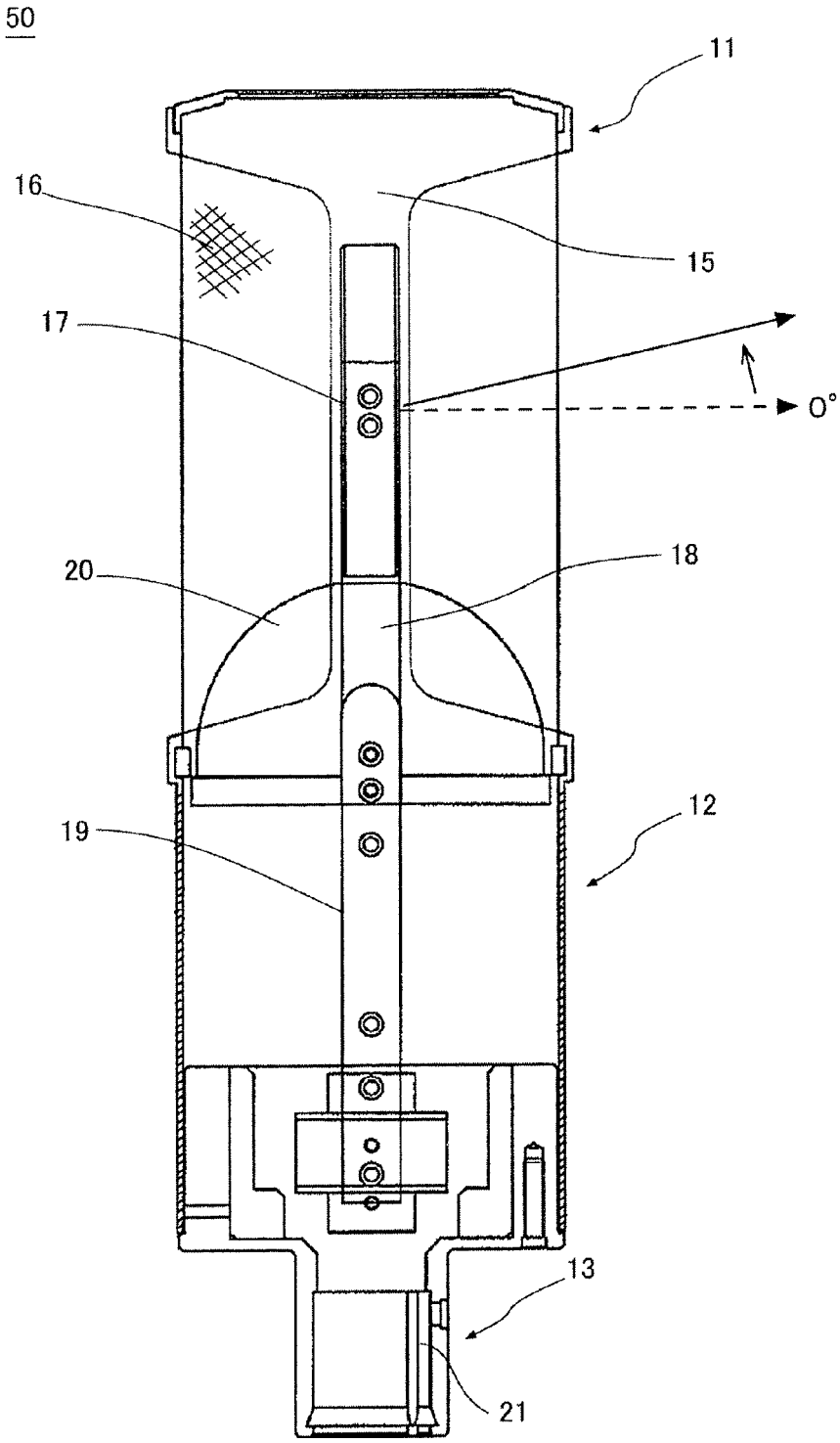
FIG. 4 Prior Art
FIG. 4 is a side sectional view of the conventional condenser microphone.
Figure 5:
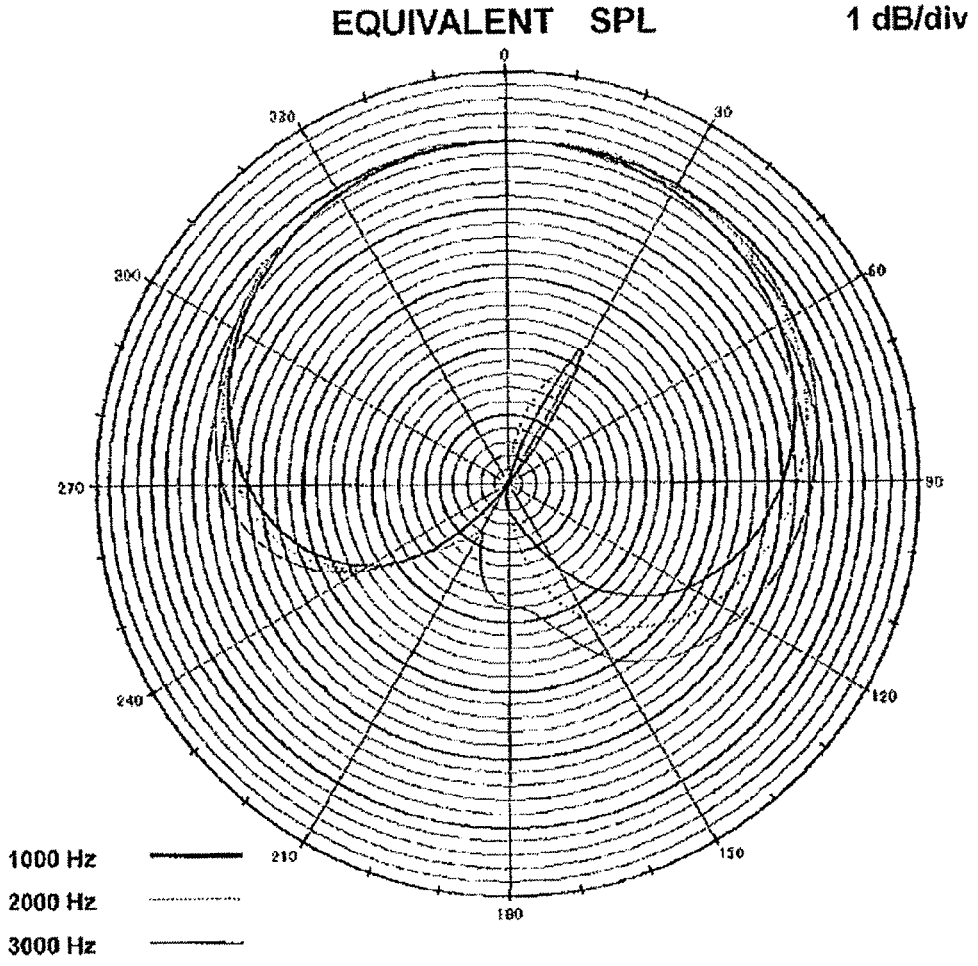
FIG.5 Prior Art
FIG. 5 shows a polar pattern showing directivity in a vertical plane of the conventional condenser microphone.
Figure 6:
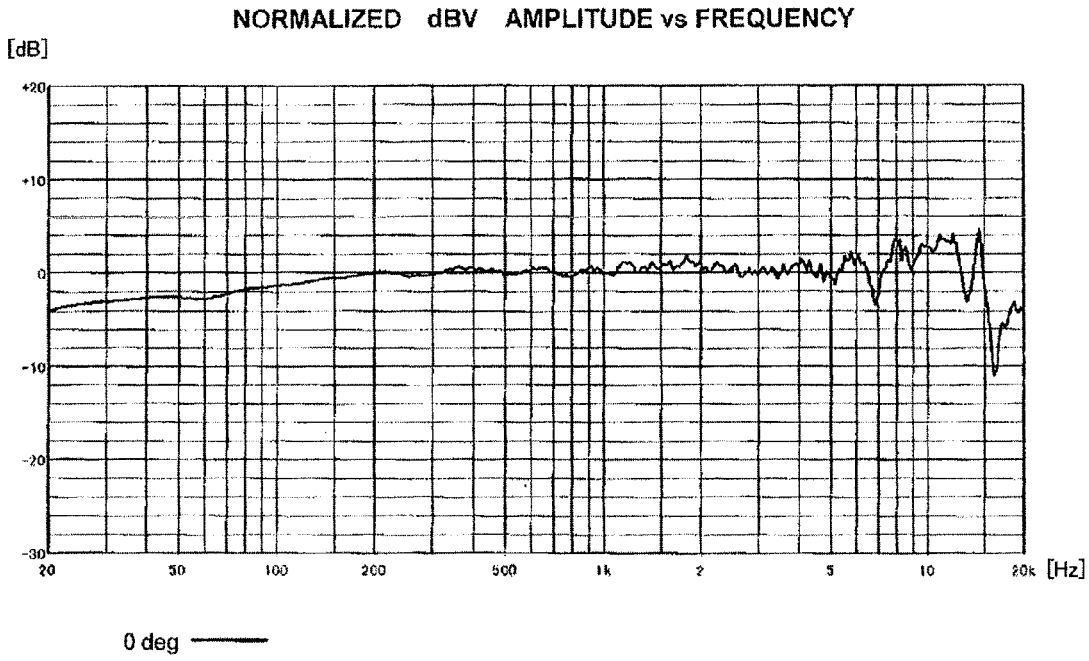
FIG. 6 Prior Art
FIG. 6 is a graph showing a directional frequency response of the conventional condenser microphone.

In FIGS. 1 and 2, same components as those in the conventional structure as previously illustrated in FIGS. 3 and 4 or components corresponding thereto are denoted by the same reference numerals, and the detailed description thereof will not be repeated.

Similar to the structure illustrated in FIGS. 3 and 4, a condenser microphone 1 in accordance with the present invention illustrated in FIGS. 1 and 2 is a side-entry condenser microphone including a head case portion 11, a body portion 12 for supporting the head case portion 11 and a connector portion 13 mounted on the lower end side of the body portion 12.

Between the illustrated condenser microphone 1 and the condenser microphone 50 as illustrated in FIGS. 3 and 4, difference lies only in the structure within the head case portion 11.

Within the head case portion 11, a microphone unit 17 is supported on both right and left sides by an up-down extending stay 18 in a vertical state so as to orient a sound collecting axis in a horizontal direction.

A first reflector member 2 is a case member of a circuit substrate 19 and formed to have a circular dome shape. The first reflector member 2 is provided below the microphone unit 17 with its convex surface oriented toward the microphone unit 17 side. This first reflector member 2 is, for example, formed of polycarbonate Further, as described the above, the first reflector member 2 is formed to have a circular dome shape so as to prevent generation of irregularities in intensity of sound waves inputted at a predetermined frequency to a sound terminal provided at a front position of the microphone unit 17.

In contrast, a second reflector member 3 being formed of the same material and formed in the same shape (i.e. circular dome shape) as the first reflector member 2 is disposed above the microphone unit 17 with its convex surface oriented toward the microphone unit 17 side (i.e. downward direction).

This second reflector member 3 and the first reflector member 2 are disposed symmetrically (disposed vertically symmetrically) with respect to the microphone unit 17, thereby preventing the sound terminals provided at the front and rear positions of the microphone unit 17 from being shifted in a vertical plane.

That is, according to this structure, even if the sound source frequency varies, the sound terminals provided at the front and rear positions of the microphone unit 17 are not shifted in the upward and downward directions, thereby preventing the directional axis from varying depending on the sound source frequency.

As described the above, according to the embodiment of the present invention, even if the first reflector member 2 which is a case member for accommodating the circuit substrate 19 is positioned to be close to the microphone unit 17, the first reflector member 2 and the second reflector member 3 formed in the same shape as the first reflector member 2 are disposed symmetrically with respect to the microphone unit 17.

Thus, the sound terminals provided at the front and rear positions of the microphone unit 17 are not shifted in the upward and downward direction, this can solve such a conventional problem that the directional axis varies depending on the sound source frequency.

It is to be noted that in the above described embodiments, although the first reflector member 2 and the second reflector member 3 are formed to have a circular dome shape, the shape is not limited thereto.

Figure 7:
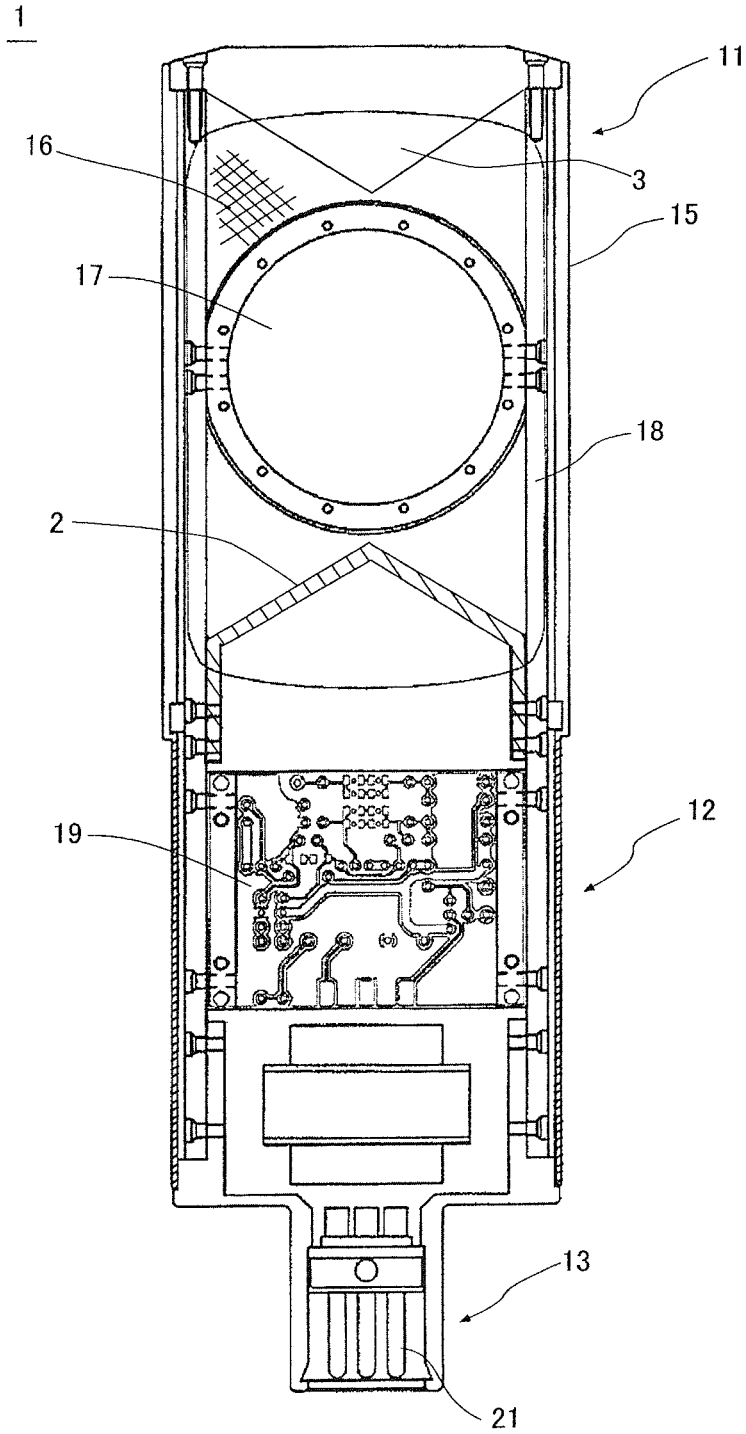
FIG. 7 is a front sectional view of a condenser microphone in accordance with another example of the present invention.

For example, they may have other shapes such as a cone shape as shown in FIG. 7. In any shape, the first reflector member 2 and the second reflector member 3 may be disposed symmetrically with respect to the microphone unit 17 with its convex surface oriented toward the microphone unit 17.

What is claimed is:

1. A condenser microphone comprising:

a microphone unit disposed in a head case so as to orient a sound collecting axis in a horizontal direction, the microphone unit being provided with sound terminals at front and rear positions thereof;

a first reflector member provided below said microphone unit, and having a convex surface facing toward a microphone unit side; and a second reflector member formed in the same shape as said first reflector member and provided above said microphone unit, said first reflector member and said second reflector member being disposed symmetrically with respect to said microphone unit.

2. The condenser microphone as claimed in claim 1, further comprising an electronic circuit substrate electrically connected to said microphone unit, said electronic circuit substrate being covered by said first reflector member.

3. The condenser microphone as claimed in claim 1, wherein said first reflector member and said second reflector member are formed to have a dome shape with the convex surface oriented toward said microphone unit side.

4. The condenser microphone as claimed in claim 1, wherein said first reflector member and said second reflector member are formed to have a cone shape with the convex conical surface oriented toward said microphone unit side.

5. A condenser microphone comprising:

a microphone unit disposed in a head case so as to orient a sound collecting axis in a horizontal direction, the microphone unit being provided with sound terminals at front and rear positions thereof;

a first reflector member disposed below said microphone unit, and having a dome shape with a convex surface oriented toward a microphone unit side; and a second reflector member formed in same shape as said first reflector member and provided above said microphone unit, said first reflector member and said second reflector member being disposed symmetrically with respect to said microphone unit.

6. A condenser microphone comprising:

a microphone unit disposed in a head case so as to orient a sound collecting axis in a horizontal direction, the microphone unit being provided with sound terminals at front and rear positions thereof;

a first reflector member disposed below said microphone unit, and having a cone shape with a convex conical surface oriented toward a microphone unit side; and a second reflector member formed in same shape as said first reflector member and provided above said microphone unit, said first reflector member and said second reflector member being disposed symmetrically with respect to said microphone unit.

* * * * *